US006698869B2

(12) United States Patent
Vosahlo

(10) Patent No.: US 6,698,869 B2
(45) Date of Patent: Mar. 2, 2004

(54) FLUID-PRESSURE CONTROLLED INK PRESSURE REGULATOR

(75) Inventor: Jindrich Vosahlo, Cambridgeshire (GB)

(73) Assignee: Inca Digital Printers Limited, Cambridge (GB)

( * ) Notice: Subject to any disclaimer, the term of this patent is extended or adjusted under 35 U.S.C. 154(b) by 0 days.

(21) Appl. No.: 10/012,245

(22) Filed: Nov. 5, 2001

(65) Prior Publication Data

US 2002/0097284 A1 Jul. 25, 2002

Related U.S. Application Data

(63) Continuation of application No. PCT/GB00/01718, filed on May 5, 2000.

(30) Foreign Application Priority Data

May 5, 1999 (GB) ..... 9910313

(51) Int. Cl.[7] ..... B41J 2/175
(52) U.S. Cl. ..... 347/85; 347/7
(58) Field of Search ..... 347/6, 7, 35, 85, 347/86, 87, 89

(56) References Cited

U.S. PATENT DOCUMENTS 4,403,227 A * 9/1983 Bertschy et al. ..... 347/89
5,369,429 A 11/1994 Erickson
5,489,925 A * 2/1996 Brooks et al. ..... 347/6
5,745,138 A 4/1998 Ostermeier
5,844,577 A 12/1998 Pawlowski, Jr.
5,880,748 A 3/1999 Childers et al.
6,302,516 B1 * 10/2001 Brooks et al. ..... 347/35

FOREIGN PATENT DOCUMENTS

| | | | |
|---|---|---|---|
| EP | 0660092 | 6/1995 | |
| EP | 0754555 | 1/1997 | |
| EP | 0805034 | 11/1997 | |
| EP | 0838339 | 4/1998 | |
| EP | 0903238 | 3/1999 | |
| EP | 1108553 | 6/2001 | |
| FR | 2707919 | 1/1995 | |
| JP | 58187362 A * | 11/1983 | ..... 347/7 |
| WO | WO00/09339 | 2/2000 | |

* cited by examiner

*Primary Examiner*—Anh T. N. Vo
(74) *Attorney, Agent, or Firm*—Michael Best & Friedrich LLP

(57) ABSTRACT

A pressure regulation system for an inkjet printer includes a chamber for containing ink, a level sensor to measure the level of ink contained in the chamber, a pressure source for providing a fluid at a controlled positive or negative gauge pressure, and a pressure control device to control the pressure source. An ink supply regulating device regulates the flow of ink and an ink flow control device controls the ink supply regulating device based on an output of the level sensor. The pressure regulation system can be mounted close to the printhead.

17 Claims, 1 Drawing Sheet

FLUID-PRESSURE CONTROLLED INK PRESSURE REGULATOR

The present application is a continuation of prior international application PCT/GB00/01718, filed on May 5, 2000, which claims the benefit and priority of United Kingdom Patent Application No. 9910313.7 filed May 5, 1999.

BACKGROUND

The invention relates to an ink pressure regulator. The invention finds particular but not exclusive application for use with inkjet printers Embodiments of the present invention relate to a vacuum-controlled ink pressure regulator for ink supplied to a drop on demand inkjet printhead. Embodiments of the present invention relates to a vacuum controlled ink pressure regulator for use with a printer using a bulk ink supply.

One known technique for regulating the pressure of ink fed to an inkjet printhead is to control the pressure in an ink reservoir which is placed close to or integrated into the printhead. However, this technique is unsuitable for applications with high ink usage and/or long autonomy requirements, where the ink reservoir needs to be large and it is impractical to mount the reservoir in close proximity to a printhead.

For systems which use ink reservoirs which are mounted remotely from the printheads they supply, a known technique for regulating the pressure of ink fed to the printhead is to regulate the ink pressure remotely front the printhead (for example at the reservoir) and connect the pressure regulator to the printhead via a long ink tube. This technique has the disadvantage of there being pressure fluctuations at the printhead due to flow-dependent hydraulic losses in the long ink tube, movement of the long ink tube or from air within the tube. Such fluctuations impair printhead performance.

Prior art pressure regulators generally use either the height of ink to control pressure (level control) or a spring, or capillary action. Examples of level control pressure regulators include Trident International's printing systems for industrial coding applications and Hewlett-Packard's off-axis 'flaccid bag' (see EP-A-0 903 238). An example of a mechanical pressure regulator using a spring mechanism is shown in U.S. Pat. No. 5,844,577. An example of a pressure regulator using capillary action is shown in U.S. Pat. No. 5,745,138.

A common method of providing a constant gauge pressure at the printhead is to expose pan of the ink system to atmospheric pressure, and control the height difference between this exposed part and the printhead. Since some drop on demand printheads require a negative gauge pressure, to provide such a negative pressure using this method, the exposed part of the ink system must be below the printhead. In applications where a print substrate is below the printhead, this exposed part of the ink system must also be below the level of the print substrate. This is very inconvenient and often requires a long ink tube between the printhead and the exposed part in order to find a suitable space.

Whilst it would be desirable to have a pressure regulator close to or at the printhead, when using a remote ink reservoir, prior art pressure regulators are generally not such that they could be simply mounted at or near the printhead. This is particularly the case when the pressure of the ink needs to be regulated to be negative at the printhead.

SUMMARY

It is an object of embodiments of the present invention to provide a pressure regulation system for an inkjet printer which allows the pressure of the ink to be regulated at or near to the printhead whilst using a remote reservoir.

An aspect of the present invention provides a pressure regulation system for an inkjet printer comprising a chamber for containing ink, level sensing means for measuring the level of ink contained in the chamber, a pressure source for providing a fluid at a controlled positive or negative gauge pressure, a pressure control means for controlling the pressure source, an ink supply regulating means for regulating the flow of ink and an ink flow control means for controlling the ink supply regulating mans based on an output of the level sensing means.

Preferably the pressure source is adapted to provide a gas in the chamber at a controlled pressure.

Preferably the level sensor includes an ultrasonic level sensing device.

Preferably the level sensor includes an optical level sensing device.

In a preferred embodiment, a flexible barrier is positioned within the chamber and the level sensing means comprises a position sensing means which senses the position of the flexible barrier.

Embodiments of the present invention overcome the problems mentioned above by allowing all the components of an ink supply system to be above the level of the printhead, even when a negative gauge pressure is required at the printhead.

Examples of pressure regulation systems according to the present invention allow regulation of the ink pressure to be carried out close to a printhead through using a fluid (preferably a gas) at a controlled pressure to control the pressure of the ink.

The present invention allows pressure regulation very close to the printhead with a small fluid volume, this is particularly useful for systems where the printheads move, but is also useful for fixed head systems. The chamber of the present invention may be mounted above the nozzle line and still provide negative pressure at the printhead. Air bubbles can rise to the float chamber where they do not cause trouble.

The present invention allows the ink supply pressure to be varied to suit current conditions or for maintenance routines if this is required.

In many cases, a negative pressure in the ink chamber is required, and in such cases the pressure source preferably comprises a vacuum source.

While the use of other fluids is contemplated, preferably the fluid is a gas, preferably air.

In embodiments of the inventions the ink supply means preferably comprises a pump. That pump can be used to assist in the efficient transfer of ink from an ink reservoir to the ink chamber.

Preferably the system further includes means for deactivating the ink supply means if the level in the chamber rises above a predetermined value. This provides a safety cut-out which stops ink flowing into the ink chamber if the level rises above a particular value.

Preferably the chamber is adapted to be mounted above a printhead. And preferably the system is adapted to be mounted above a printhead.

The invention further provides an ink delivery system for an inkjet printer comprising:

an ink chamber arranged for receiving ink from a reservoir;

an ink supply device for transferring ink from the reservoir to the ink chamber;

a control device for controlling the ink supply device; and a sensor for determining the level of ink in the ink chamber and sending an output to the control device;

wherein the control device is adapted to control the ink supply device based on the output from the sensor.

Preferably the ink delivery system further includes a pressure source for applying a pressure to the ink chamber.

The invention also provides a control device for an ink delivery system, the control device comprising:

an input for receiving a signal from the sensor representative of the level of ink in the ink chamber; and an output for sending a signal to the ink supply device, wherein the control device is programmed to send a signal to the ink supply device when the signal from the sensor indicates that the ink in the ink chamber is at a predetermined level. The control device may include a suitably programmed processor.

A further aspect of the invention provides a pressure regulation system for an inkjet printer comprising an ink chamber arranged for receiving ink from a reservoir; and a pressure source for applying a pressure to the ink chamber, Also provided by the invention is an inkjet printer comprising an ink delivery system, a control device or a pressure regulation system as described herein.

The invention further provides a method of regulating pressure in an inkjet printer comprising:

applying a pressure to an ink chamber;

determining the level of ink in the ink chamber; and activating an ink supply device to supply ink to the ink chamber when the level is at a predetermined value.

The invention also provides a computer program and a computer program product for carrying out any of the methods described herein, and a computer readable medium having stored thereon a program for carrying out any of the methods described herein.

The invention also provides a method substantially as described herein with reference to the accompanying drawings, and apparatus substantially as described herein with reference to and as illustrated in the accompanying drawings.

Apparatus features may be applied to the method features and vice versa. Features of one aspect of the invention may be applied to features of another aspect of the invention.

Further aspects, advantages and objectives of the invention will become apparent from a consideration of the drawings and the ensuing description, which, by way of example, describe embodiments of the present invention in which the pressure source is a vacuum source and a solenoid-driven on-off valve is used as the ink supply regulating means.

BRIEF DESCRIPTION OF THE DRAWINGS

Embodiments of the invention will now be described, by way of example, having reference to the drawings, of which.

DETAILED DESCRIPTION OF THE INVENTION

Figure 1:
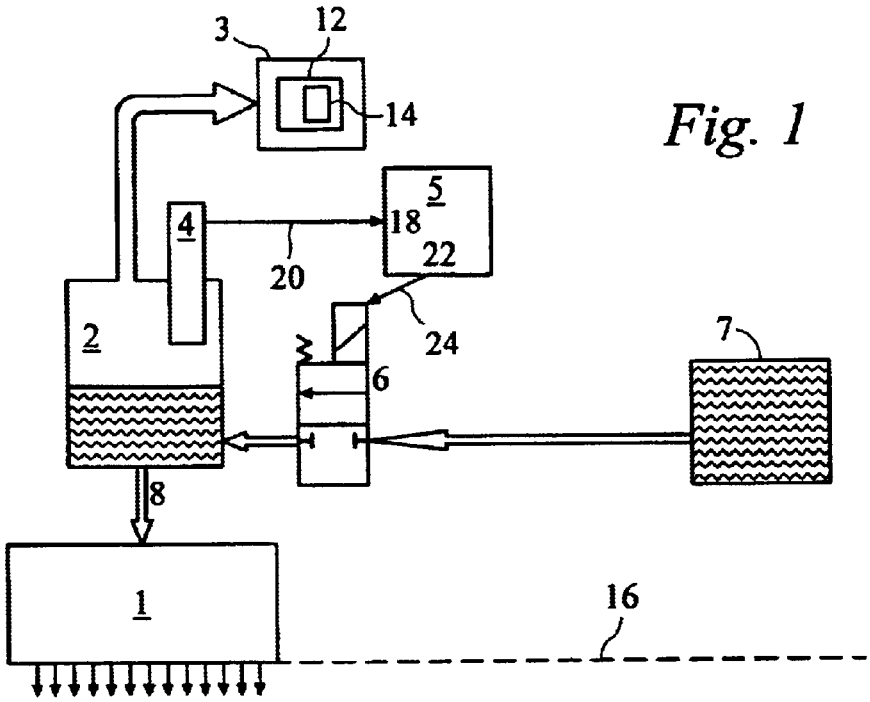
FIG. 1: Schematic diagram of an ink pressure regulator arrangement.

FIG. 1 shows a printhead (1) which is fed with ink (8) from a chamber (2). A level sensor (4) within the chamber measures the level of ink within the chamber and outputs a signal to an ink flow controller (5) which controls a solenoid-driven on-off ink supply valve (6). Ink is supplied to the chamber (2) from an ink reservoir (7). A controllable vacuum source (3) comprising a pressure control device (12) including a pressure sensor (14) is used to control the pressure of the space above the ink in the chamber (2).

The pressure of the ink being supplied to the printhead (1) depends on the height of the chamber (2) above the printhead (1) and the gauge pressure of the controlled vacuum source (3) applied to the top of the chamber (2).

A level sensor (4) is used to enable the ink flow controller (5) to maintain the ink level using the ink supply valve (6) When the level is low, the ink flow controller (5) opens the ink supply valve (6) allowing ink to flow from the ink reservoir (7) into the chamber (2). Opening and shutting the ink supply valve (6) does not affect the pressure of ink supplied to the printhead because of the free surface in the float chamber.

FIG. 1 shows the ink flow controller (5) which comprises: an input (18) for receiving a signal (20) from the sensor (4) representative of the level of ink in the ink chamber; and an output (22) for sending a signal (24) to the ink supply device (6) wherein the ink flow controller (5) is programmed to send a signal (24) to the ink supply device (6) when the signal (20) from the sensor (4) indicates that the ink in the ink chamber (2) is at a predetermined level.

Bubbles within the ink (8) in the tubing between the chamber (2) and the print (1) will tend to rise into the chamber (1) where they are harmless.

The level sensor (4) may be a float switch, an optical device, an ultrasonic device, or any other suitable level sensing device.

The controlled vacuum can be, for example, generated using a vacuum pump, a solenoid valve, a vacuum reservoir and an accurate pressure sensor (14). A single controlled vacuum source can be used to control multiple printheads with multiple chambers.

The printhead (1) can be flushed through with ink for maintenance by varying the controlled vacuum. This can be done by switching the chamber between the controlled vacuum supply and ambient pressure, in this way a single head can be flushed while a single controlled vacuum is supplying many heads.

In order to cause the ink to flow through the supply valve to the printhead, the supply reservoir (6) may be pressurised. Alternatively, since some printheads act as pumps and so can "suck" in the ink, the supply reservoir may be at ambient (or even negative) pressure. Other means of causing the ink to flow are also known to the person skilled in the art.

An electromechanical pump can be used in conjunction with a non-return valve as an alternative to the solenoid-driven ink supply valve.

Care is needed to make sure that the ink level cannot accidentally get so high that ink enters the vacuum system. This can be achieved by having a second 'safety' level sensor to cut off the ink supply (not shown), and/or by monitoring the ink supply 'on'-tine and shutting down if apparent ink consumption is excessive.

Figure 2:
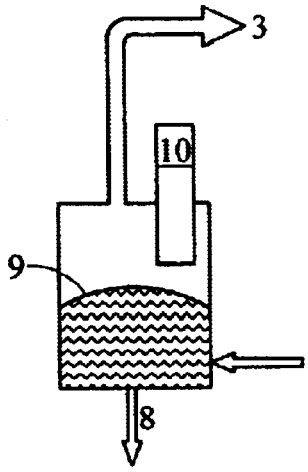
FIG. 2: Schematic diagram of an example of a level sensing means

The chamber (2) can be realised as a plenum chamber (FIG. 2) where the ink is sealed from the gas by a thin flexible barrier (9). This prevents air diffusing into the ink, and also prevents volatile components of the ink being lost. It also prevents ink entering the vacuum system (3). In this case, a position sensor (10) sensing the position of the flexible barrier (9) is used as the level sensor.

Even when a negative pressure is required at the printhead, the chamber (2) can be positioned above the printhead (1), since the negative pressure is provided by the vacuum source. It is most convenient to be able to locate all components of an ink supply system above the level (16) of a printhead when printing downwards.

It will be understood that the present invention has been described above purely by way of example and modifications of detail can be made within the scope of the invention.

Each feature disclosed in the description, and (where appropriate) the claims and drawings may be provided independently or in any appropriate combination.

What is claimed is:

1. A pressure regulation system for a downward printing inkjet printer comprising:

a downward facing printhead for printing downwards onto a substrate;

an ink chamber arranged to receive ink from a reservoir;

an ink supply device for transferring said ink from the reservoir to the ink chamber;

a level sensor arranged to determine the level of said ink in the chamber;

an ink flow control device to control the ink supply device based on the level of said ink in the ink chamber;

a pressure source to provide a gas in the chamber at a controlled pressure; and a pressure control device to control the pressure; wherein the ink chamber, the ink supply device and the reservoir are mounted above the level of said downward facing printhead.

2. A pressure regulation system according to claim 1, wherein the pressure source is adapted to provide the gas at said controlled pressure in the ink chamber wherein said controlled pressure is a negative gauge pressure.

3. A pressure regulation system according to claim 1, wherein the pressure control device includes a pressure sensor.

4. A pressure regulation system according to claim 1, wherein the ink chamber comprises only one cavity for holding the ink.

5. A pressure regulation system according to claim 1, wherein the level sensor includes an ultrasonic level sensing device.

6. A pressure regulation system according to claim 1, wherein the level sensor includes an optical level sensing device.

7. A pressure regulation system according to claim 1 in which a flexible barrier is positioned within the chamber and the level sensor includes a position sensor for sensing the position of the flexible barrier.

8. A pressure regulation system according to claim 1, wherein the ink supply device is a solenoid operated valve.

9. A pressure regulation system according to claim 1, wherein the pressure source includes a vacuum source.

10. A pressure regulation system according to claim 1, wherein the ink supply device includes a pump.

11. A pressure regulation system according to claim 1, further including a deactivation device to deactivate the ink supply device if the level in the chamber rises above a predetermined value.

12. A pressure regulation system according to claim 1, wherein the level sensor, the ink flow control device, the pressure source and the pressure control device are adapted to be mounted above the level of said downward facing printhead.

13. An inkjet printer comprising a pressure regulation system according to claim 1.

14. An ink delivery system for a downward printing inkjet printer comprising:

a downward facing printhead for printing downwards onto a substrate;

an ink chamber arranged to receive ink from a reservoir;

an ink supply device for transferring said ink from the reservoir to the ink chamber;

a control device to control the ink supply device;

a sensor arranged to determine the level of said ink in the ink chamber and send an output to the control device; and wherein the control device is adapted to control the ink supply device based on the output from the sensor and wherein the ink chamber, the ink supply device and the reservoir are mounted above the level of said downward facing printhead.

15. An ink delivery system according to claim 14, further including a pressure source for applying a controlled pressure to the ink chamber.

16. A control device for an ink delivery system according to claim 14 comprising:

an input for receiving a first signal from the sensor representative of the level of ink in the chamber; and an output for sending a second signal to the ink supply device, wherein the control device is programmed to send a said second signal to the ink supply device when the first signal from the sensor indicates that the ink in the ink chamber is at a predetermined level.

17. A method of regulating pressure in a downward printing inkjet printer having a downward facing printhead, an ink chamber arranged to receive ink from a reservoir and an ink supply device, the method comprising:

applying a controlled pressure, with a pressure control device, to the ink chamber;

determining the level of said ink in the ink chamber; and activating the ink supply device from an ink flow control device to supply ink to the ink chamber when the ink level is at a predetermined value, and wherein the ink chamber, the ink supply device and the reservoir are mounted above the level of said downward facing printhead.

* * * * *